US005251781A

United States Patent [19]

Skelton

[11] Patent Number: 5,251,781

[45] Date of Patent: Oct. 12, 1993

[54] METHOD FOR STEADILY HOLDING A CONTAINER

[76] Inventor: Christopher R. Skelton, 2304 Lark Dr., Colorado Springs, Colo. 80909

[21] Appl. No.: 952,697

[22] Filed: Sep. 25, 1992

Related U.S. Application Data

[63] Continuation of Ser. No. 718,637, Jun. 21, 1991, abandoned.

[51] Int. Cl.[5] ..... B65D 25/28

[52] U.S. Cl. ..... 220/755; 220/756; 220/757; 220/760; 220/773; 224/217

[58] Field of Search ..... 220/755, 756, 757, 760, 220/773; 224/217

[56] References Cited

U.S. PATENT DOCUMENTS

| | | | |
|---|---|---|---|
| 584,718 | 6/1897 | Witcher . | |
| 912,526 | 2/1909 | Bark . | |
| 1,157,475 | 10/1915 | Webster . | |
| 1,431,336 | 10/1922 | Smith . | |
| 1,865,283 | 6/1932 | Sohnze | 220/756 |
| 2,227,278 | 12/1940 | Slater . | |
| 2,294,197 | 8/1942 | Moore et al. . | |
| 3,186,414 | 6/1965 | Davis . | |
| 3,419,196 | 12/1968 | Moore . | |
| 4,205,411 | 6/1980 | Cupp et al. | 220/756 |
| 4,759,306 | 7/1988 | McKenzie . | |

*Primary Examiner*—Joseph Man-Fu Moy
*Attorney, Agent, or Firm*—Brian D. Smith

[57] ABSTRACT

Method and apparatus for steadily holding a container in one hand are disclosed. The container has a bottom, side and a swing handle. The apparatus of the invention includes a loop attached to the swing handle for receiving a person's thumb. The loop is sized and configured to enable the container to be steadily held when a thumb is received in the loop with the fingers of the same hand located against the bottom of the container. The method of the present invention includes providing such a container having a swing handle with a loop as described above for receiving a person's thumb. The method further includes engaging the loop with a thumb of one hand and engaging the bottom of the container with the fingers of the same hand so that the thumb and fingers cooperate to enable the person to steadily hold the container in one hand.

8 Claims, 3 Drawing Sheets

METHOD FOR STEADILY HOLDING A CONTAINER

This is a continuation, of the application Ser. No. 718,637 filed Jun. 21, 1991 now abandoned.

TECHNICAL FIELD

The invention relates generally to method and apparatus for holding containers and more particularly to method and apparatus for facilitating the steady holding of a container in one hand.

BACKGROUND ART

There are various types of devices for facilitating the gripping of objects such as the supporting assembly for gripping a rod or pole as described in U.S. Pat. No. 4,759,306 to McKenzie. However, there are no devices or apparatus known to the inventor of the instant invention for facilitating the steady holding of a container having an open top in one hand without obstructing access to the container through the open top of the container. The swing handle of most containers such as a one gallon paint can restricts access through the open top of the container when the paint can is held by the handle. This is particularly a problem for painters trying to dip a paint brush into a paint can.

DISCLOSURE OF THE INVENTION

The present invention provides a method and apparatus for facilitating the steady holding of a container having an open top in one hand. The method and apparatus of the present invention is unique in that it does not restrict access to the interior of a container through the container's open top. The container to which the invention applies typically has a bottom, a side and a swing handle such as a conventional one gallon paint can. The apparatus for steadily holding the container in one hand includes thumb engaging means attached to the swing handle of the container for receiving a person's thumb. The thumb engaging means allows the container to be steadily held in one hand when a thumb is engaging the thumb engaging means with the fingers and palm of the same hand located against the bottom of the container.

In a preferred embodiment of the invention, the thumb engaging means includes a flexible strap having hook and loop fasteners located on opposite sides of the strap at opposite ends thereof. The strap is attached to the swing handle of the container by looping it around the swing handle and then engaging the hook fasteners located on one side of the strap with the loop fasteners located on the other side of the strap.

The method of the present invention for steadily holding a container in one hand includes providing the swing handle of the container with thumb engaging means as described above for receiving a person's thumb. The method further includes engaging the thumb engaging means with a thumb of one hand and engaging the bottom of the container with the fingers and palm of the same hand so that the container can be steadily held.

A preferred method for steadily holding a container in one hand includes providing a container having a swing handle and providing a generally rectangularly shaped, flexible strap having a swatch of hook fasteners located on one side of the strap at one end thereof and a swatch of loop fasteners located on the opposite side of the strap at the other end thereof. The method further includes looping the strap about the swing handle and then pressing the swatches of hook and loop fasteners together to form a loop about the swing handle having a diameter which enables a person to steadily hold the container in one hand when a thumb is inserted in the loop with the fingers and palm of the same hand located against the bottom of the container. The method further includes inserting the thumb of one hand into the loop and locating the fingers and palm of the same hand against the bottom of the container so that the thumb and fingers cooperate to enable the person to steadily hold the container in one hand.

BRIEF DESCRIPTION OF THE DRAWINGS

Other features of this invention will appear in the following description and amended claims, reference being made to the accompanying drawing forming a part of the specification where like referenced characters designate corresponding parts in the views.

BEST MODE FOR CARRYING OUT THE INVENTION

Figure 2:
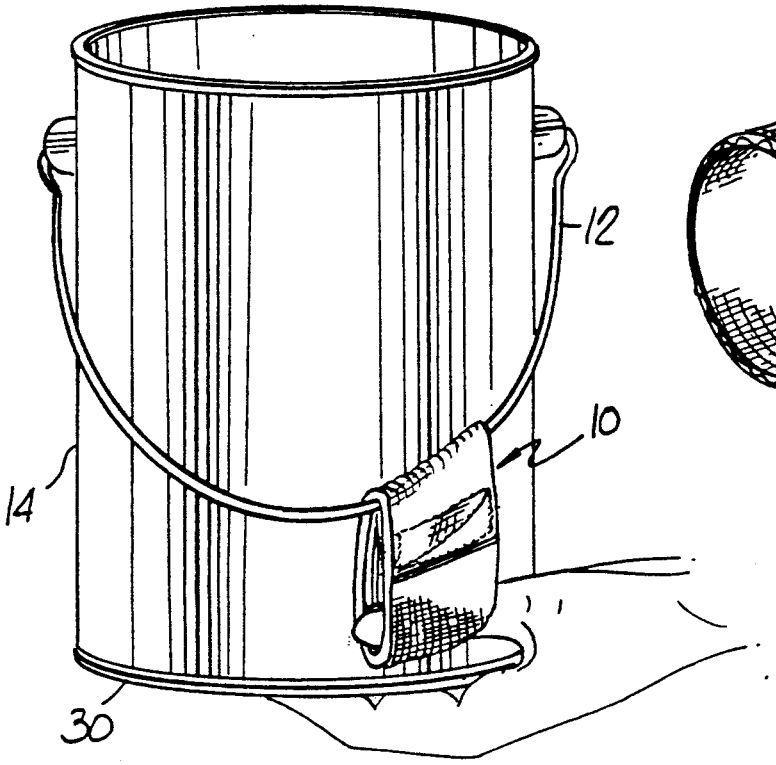
FIG. 2 is a perspective view illustrating an individual holding the paint can in one hand in accordance with the method of the present invention.

FIGS. 1 through 3 and 5 and 6 illustrate an adjustable loop 10 of the present invention (or thumb engaging means 10) looped about a swing handle 12 of a conventional one gallon paint can 14. Loop 10 enables a person to steadily hold a container in one hand when as illustrated in FIG. 2 a person's thumb is inserted in the loop and the person's fingers palm of the same hand are located against the bottom of the container.

Figure 5:
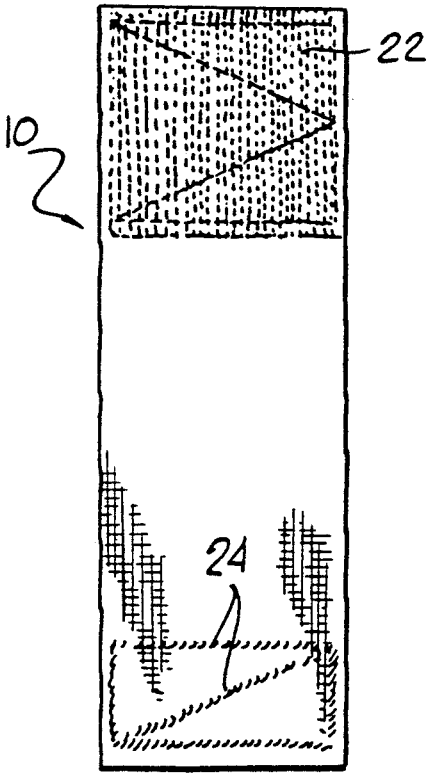
FIG. 5 is a top plan view showing the loop of FIG. 1 in its unlooped state prior to being looped about the swing handle of the container of FIG. 1.
Figure 6:
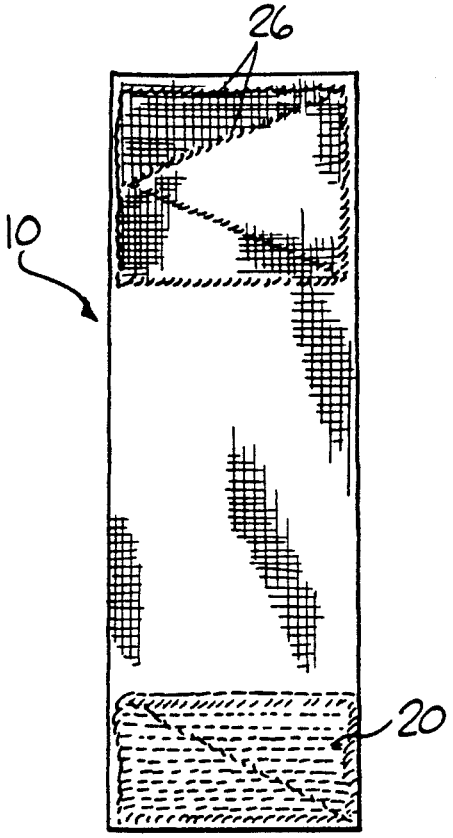
FIG. 6 is a bottom plan view of the strap of FIG. 5.

FIGS. 5 and 6 illustrate loop 10 before it is formed into a loop. In this unlooped condition, loop 10 essentially consists of a strap of flexible material such as polypropylene webbing having a swatch 20 of nylon based hook-type fasteners located on one side of the strap at one end thereof and a swatch 22 of nylon based loop fasteners located on the other side of the strap at the other end thereof. FIG. 5 provides a top plan view of the strap which illustrates that swatch 22 of loop fasteners is located at one end of the strap while stitching 24 (which secures swatch 20 of hook fasteners to the other side of the strap) is located at the other end of the strap. FIG. 6 provides a bottom plan view of the same strap illustrating swatch 20 of hook fasteners and stitching 26 which secures swatch 22 of loop fasteners to the other side and end of the strap.

Figure 1:
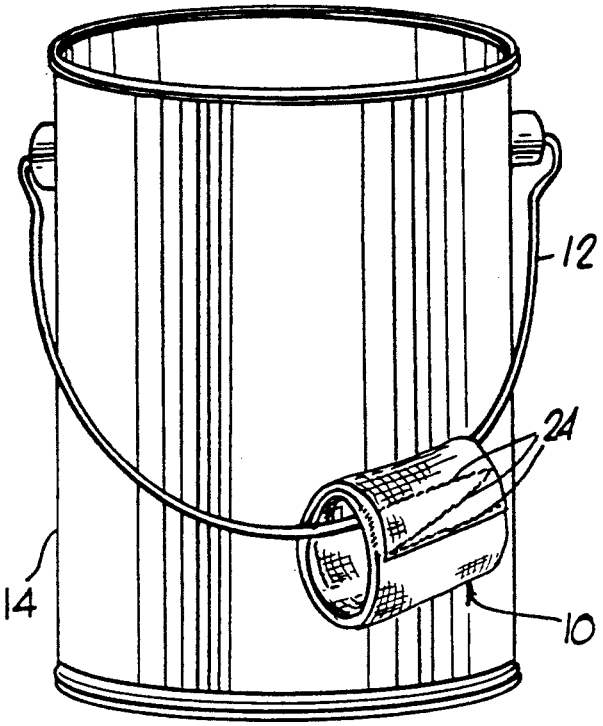
FIG. 1 is a perspective view showing an adjustable loop of the present invention secured to the swing handle of a conventional paint can.
Figure 3:
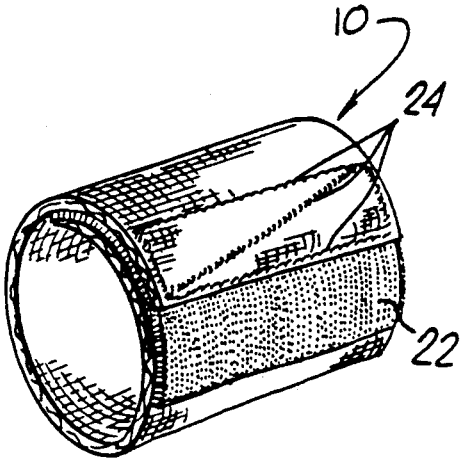
FIG. 3 is a perspective view of the adjustable loop of FIG. 1.

FIG. 3 illustrates that loop 10 is formed by forming the strap illustrated in FIGS. 5 and 6 into a loop and then pressing swatches 20 and 22 together so that the hook fasteners engage the loop fasteners.

As previously mentioned, FIG. 2 illustrates an individual steadily holding the container in one hand with a thumb inserted into loop 10 and with fingers of the same hand located against the bottom of the container. It can also be seen in FIG. 2 also illustrates that the individual's palm is resting against the bottom edge or rim 30 of the container which provides further support for steadily holding the container in one hand in accordance with the present invention. It will also be appreciated that swatch 22 of loop fasteners is significantly wider than swatch 20 of hook fasteners. This enables one to adjust the diameter of loop 10 so that the loop can accommodate individuals having differently sized thumbs and hands when the loop is secured about handle 12 of the container. Swatches of hook and loop fasteners such as swatches 20 and 22 are sold under the trademark Velcro and are available from Velcro U.S.A. of Manchester, N.H. Velcro U.S.A. also manufactures straps which are similar to that of the present invention. A preferred strap for use in forming loop 10 has a length of 5½ inches and a width of approximately 1 to 2 inches. Swatch 20 preferably has a length of 1 inch and swatch 22 preferably has a length of 2 inches.

Figure 4:
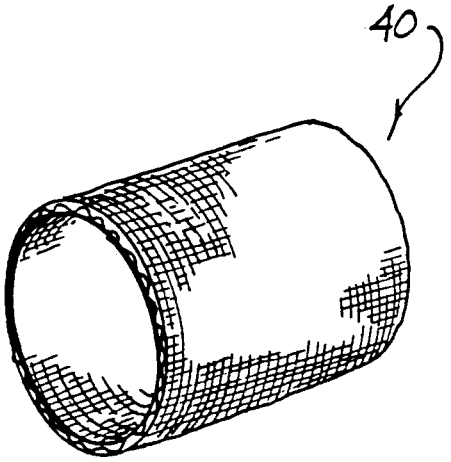
FIG. 4 is a perspective view of another loop of the present invention.
Figure 7:
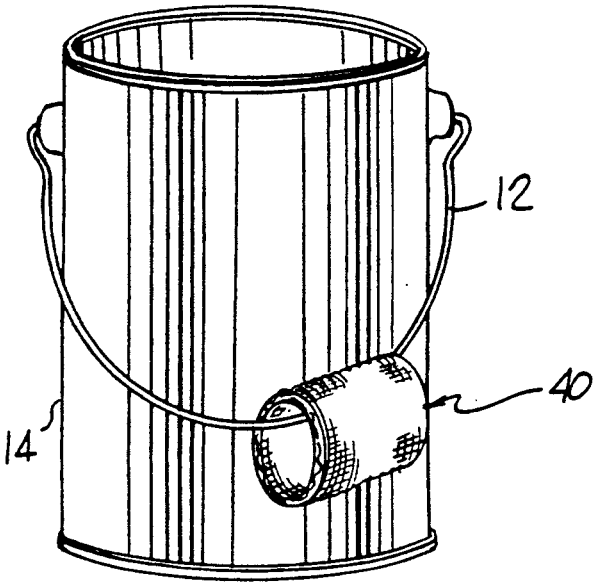
FIG. 7 is a perspective view showing the loop of FIG. 4 looped about the swing handle of a conventional paint container.

FIG. 4 illustrates a continuous loop 40 of the present invention which is preferably formed from a thin flexible tube of polyethylene which can be cut as desired to provide the loop with a desired width of between 1 to 2 inches and a desired inside diameter of about 1 to 2 inches when used with a standard swing handle on a conventional one gallon paint can. Loop 40 is preferably looped over swing handle 12 of container 14 before swing handle 12 is attached to container 14 as illustrated in FIG. 7. Thus, loop 40 is ideally suited for use by a paint manufacturer who can install loop 40 on the swing handle prior to packing and shipping the containers. Loop 40 is used in accordance with the present invention in the safe manner loop 10 is used except, of course, the diameter of loop 40 is not adjustable since it is not provided with hook and loop fasteners.

Figure 8:
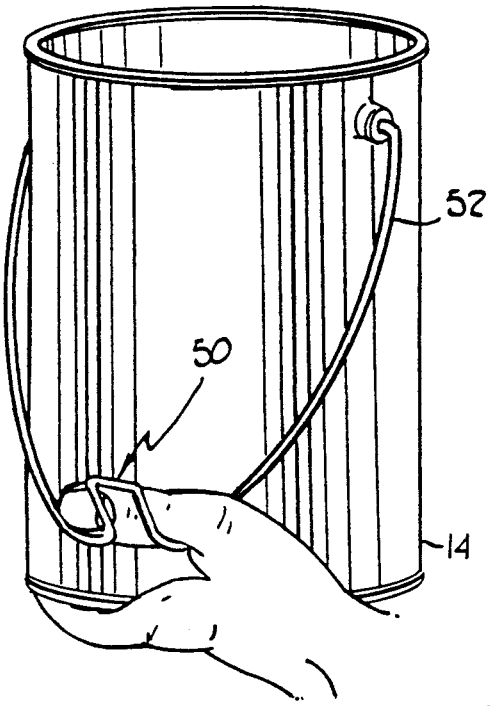
FIG. 8 is a perspective view showing a handle of a conventional paint container which has been formed with another loop of the present invention enabling an individual to steadily hold a container in on hand.
Figure 9:
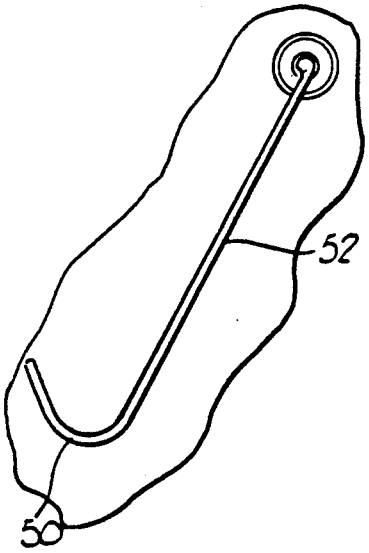
FIG. 9 is a side view of the swing handle and loop of FIG. 8.

FIGS. 8 and 9 illustrate another embodiment of the present invention having a loop 50 or thumb engaging means 50 which is integral with a swing handle 52 of the container. This version is also ideally suited for use by paint manufacturers who can form loop 50 into swing handle 52 at the factory prior to packing and shipping the containers. Loop 50 is also used in the same manner as loop 10 to steadily hold a container in one hand..

Figure 10:
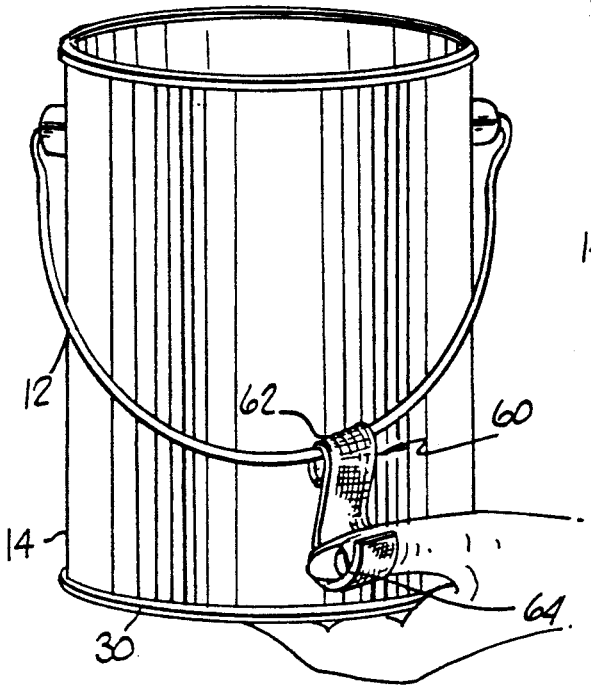
FIG. 10 is a perspective view showing another loop or thumb engaging means of the present invention.

FIG. 10 illustrates another embodiment of the present invention having a rigid hook-shaped member 60. Hook-shaped member 60 has an end 62 which is looped about the container's swing handle and, thus, is pivotally and slideably secured to the swing handle. Hook-shaped member 60 is also provided with a hook-shaped free end 64 for receiving a thumb of a person's hand in accordance with the present invention to steadily hold the container in one hand. Hook-shaped member 60 is preferably made from a generally rigid or at least highly resilient material such as plastic. The hook-shaped member is also ideally suited for use by paint manufacturers who can attach or secure hook-shaped member 60 to the swing handle of the container prior to packing and shipping the container.

Figure 11:
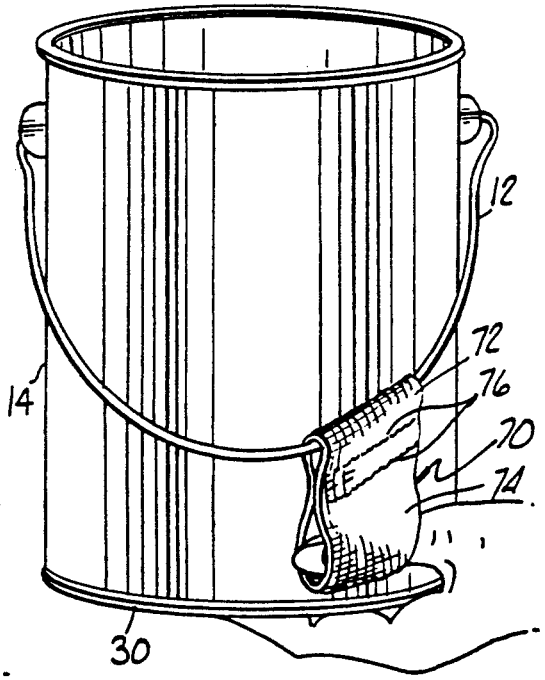
FIG. 11 is a perspective view showing yet another loop or thumb engaging means of the present invention.

FIG. 11 illustrates yet another embodiment of the present invention which includes a double looped strap of flexible material such as polypropylene webbing. Strap 70 is provided with a first loop 62 which is looped about the swing handle of the container and a second looped end 74 for receiving the thumb of a hand in accordance with the present invention. The loops are formed by stitching (see stitching 76) opposite sides of strap 70 together as illustrated. Double looped strap 70 is also ideally suited for use by paint manufacturers who have the capability of installing strap 70 on the swing handle of a paint can prior to packing and shipping the container.

While the above invention has been shown and described in detail in the application, it should be understood that this invention is not to be limited to the exact form disclosed and changes in detail and construction of the invention may be made without departing from the spirit thereof.

What is claimed:

1. A method for steadily holding a container such as a paint can in one hand, said method comprising:

providing a container having a bottom, at least one side, and a swing handle with thumb engaging means for receiving a person's thumb so that the container can be steadily held in one hand when the thumb is engaging the thumb engaging means with the fingers and palm of the same hand located against the bottom of the container; and engaging the thumb engaging means with at thumb of one hand and the bottom of the container with the fingers and palm of the same hand so that the container can be steadily held.

2. A method as claimed in claim 1 wherein the thumb engaging means includes a rigid, hook-shaped member also having a free end which is generally hook shaped for receiving the thumb of a person'hand.

3. A method as claimed in claim 1 wherein the swing handle has a generally U-shape with the free ends for pivotal attachment to oppositely facing surfaces of the container's side and wherein the thumb engaging means includes an integral hook-shaped portion located at the base of the swing handle's U, the hook-shaped portion being sized and configured to receive a person'thumb so that the container can be steadily held in one hand when the thumb is engaging the hook-shaped portion with the fingers and palm of the same hand located against the bottom of the container.

4. A method as claimed in claim 3 wherein substantially all of the swing handle lies in a plane except the hook-shaped portion which projects outwardly from the plane of the swing handle.

5. A method as claimed in claim 1 wherein the container is steadily held by locating the fingers and the center of the palm of the same hand against the bottom of the container.

6. A method for steadily holding a container such as a paint can in one hand, said method comprising:

providing a container having a bottom, at least one side, and a swing handle, the swing handle having a generally U-shape with free ends for pivotal attachment to oppositely facing surfaces of the container's side, the swing handle further having an integral hook-shaped portion located at the base of the swing handle's U, the hook-shaped portion being sized and configured to receive a person's thumb so that the container can be steadily held in one hand when the thumb is engaging the hook-shaped portion with the fingers and palm of the same hand located against the bottom of the container; and engaging the hook-shaped portion of the swing handle with a thumb of one hand and the bottom of the container with the fingers and palm of the same hand so that the container can be steadily held.

7. A method as claimed in claim 6 wherein substantially all of the swing handle lies in a single plane except its hook-shaped portion, the hook-shaped portion projecting outwardly from the single plane of the swing handle and upwardly when the swing handle is pivotally attached to the container's side.

8. A method for steadily holding a container such as a paint can in one hand, said method comprising:

providing a container having a swing handle, a bottom, at least one side, and thumb engaging means attached to the swing handle of the container for receiving a person'thumb so that the container can be steadily held in one hand when the thumb is engaging the thumb engaging means with the fingers and palm of the same hand located against the bottom of the container, the thumb engaging means including a rigid, hook-shaped member having one end pivotally and slidably secured to the swing handle, the rigid, hook-shaped member also having a free end which is generally hook shaped for receiving the thumb of a person's hand; and, engaging the hook-shaped free end of the thumb engaging means with a thumb of one hand and the bottom of the container with the fingers and palm of the same hand so that the container can be steadily held.

* * * * *